US010711758B2

(12) United States Patent
Huberts et al.

(10) Patent No.: US 10,711,758 B2
(45) Date of Patent: Jul. 14, 2020

(54) SYSTEM AND METHOD FOR MONITORING AN IGNITION SYSTEM

(71) Applicant: Ford Global Technologies, LLC, Dearborn, MI (US)

(72) Inventors: Garlan Huberts, Milford, MI (US); Qiuping Qu, Troy, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 41 days.

(21) Appl. No.: 16/120,038

(22) Filed: Aug. 31, 2018

(65) Prior Publication Data

US 2020/0072179 A1 Mar. 5, 2020

(51) Int. Cl.

| | |
|---|---|
| ***F02P 1/00*** | (2006.01) |
| ***F02P 17/12*** | (2006.01) |
| ***F02P 5/04*** | (2006.01) |
| ***F02P 5/15*** | (2006.01) |

(52) U.S. Cl.

CPC ..... *F02P 17/12* (2013.01); *F02P 5/045* (2013.01); *F02P 5/1502* (2013.01); *F02P 2017/121* (2013.01)

(58) Field of Classification Search

CPC ..... F02P 17/12; F02P 2017/125; F02P 3/045; F02P 3/0453; F02P 9/002

USPC ..... 123/594, 609

See application file for complete search history.

(56) References Cited

U.S. PATENT DOCUMENTS

| | | | | |
|---|---|---|---|---|
| 4,913,123 | A * | 4/1990 | DeBiasi | F02P 3/0456 123/406.19 |
| 6,314,803 | B1 | 11/2001 | Pennese et al. | |
| 6,384,606 | B1 | 5/2002 | Nussbaum | |
| 6,883,509 | B2 | 4/2005 | Porter et al. | |
| 7,137,382 | B2 * | 11/2006 | Zhu | F01N 3/2006 123/435 |

* cited by examiner

*Primary Examiner* — John Kwon

(74) *Attorney, Agent, or Firm* — Geoffrey Brumbaugh; McCoy Russell LLP

(57) ABSTRACT

A system for monitoring and cleaning a spark plug is disclosed. In one example, rim firing of a spark plug is detected according to characteristics of a voltage of a primary coil of an ignition coil. The system may institute spark plug cleaning after rim firing of a spark plug is detected.

7 Claims, 9 Drawing Sheets

SYSTEM AND METHOD FOR MONITORING AN IGNITION SYSTEM

FIELD

The present description relates to a system for monitoring operation of an ignition system of a spark ignited engine. The system may be particularly useful for determining when to activate a spark plug rim fire compensation mode.

BACKGROUND AND SUMMARY

A spark plug of an internal combustion engine may become fouled via wet fuel, carbon deposits, or fuel additives. The spark plug includes a center electrode that is surrounded by a ceramic insulator, except at the tip of the spark plug where the center electrode is exposed and proximate to a ground electrode that is part of the spark plug casing. The fuel and deposits may make the ceramic insulator conductive so that spark is not initiated in the gap between the center electrode and the ground electrode. Rather, the spark plug may discharge in a crevice volume that is located between the ceramic insulator and the spark plug casing. This type of discharge may be described as a rim fire and a rim fire spark event may lead to late burning of gases in the cylinder or a misfire. Late burns and misfires may reduce engine power and increase engine emissions. Therefore, it may be desirable to provide a way of identifying rim firing events and mitigate the possibility of additional rim firing events.

The inventors herein have recognized the above-mentioned disadvantages and have developed a spark plug monitoring system, comprising: an engine with an ignition coil including a primary coil; and a controller including executable instructions stored in non-transitory memory to integrate a voltage of the primary coil beginning a first predetermined time after the ignition coil begins to discharge to a second predetermined time after the ignition coil begins to discharge, and instructions to adjust operation of the engine responsive to the integration via the controller.

By monitoring a voltage of a primary ignition coil, it may be possible to provide the technical result of determining the presence or absence of a rim firing spark plug. In particular, once discharge of a secondary coil that is magnetically coupled to the primary ignition coil begins, a voltage of the primary coil may be integrated and the value of the integration may be indicative of the presence or absence of rim firing of a spark plug. If rim firing is indicated, the engine may be operated at a higher load and/or with a leaner air-fuel mixture to reduce the possibility of further rim firing events.

The present description may provide several advantages. In particular, the approach detects spark plug rim firing in an unobtrusive way so that engine operation may not be influenced by the monitoring. In addition, the approach may detect rim firing via a voltage slope, voltage level, or integrated voltage value so that processing power of the engine controller may be matched to the method of monitoring the spark plug. Further, the approach provides for actions to reduce the possibility of further spark plug rim firing events so as to improve engine operation.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 4:
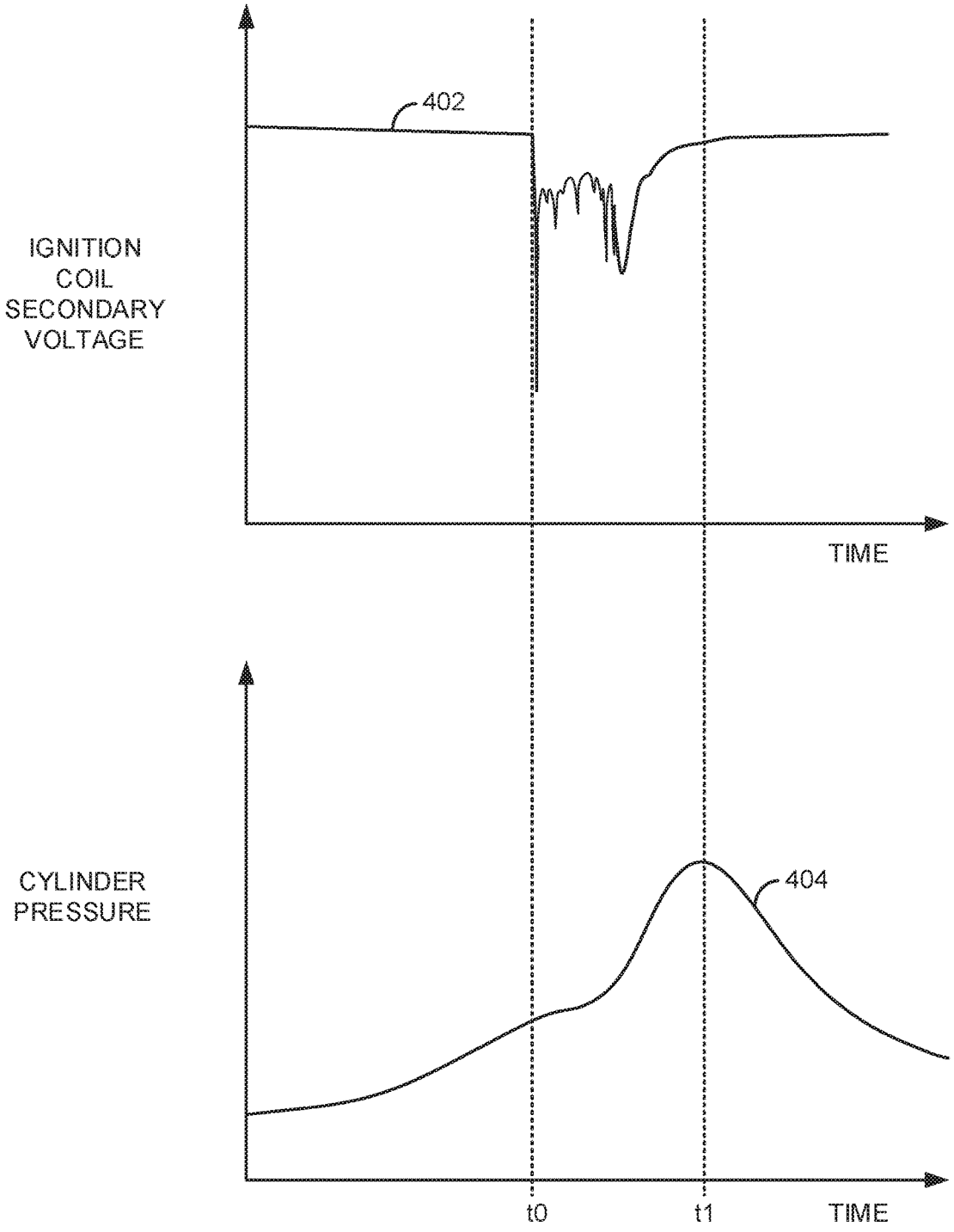
FIG. 4 shows signals of interest for an ignition coil discharge resulting from a spark plug gap spark event.
Figure 5:
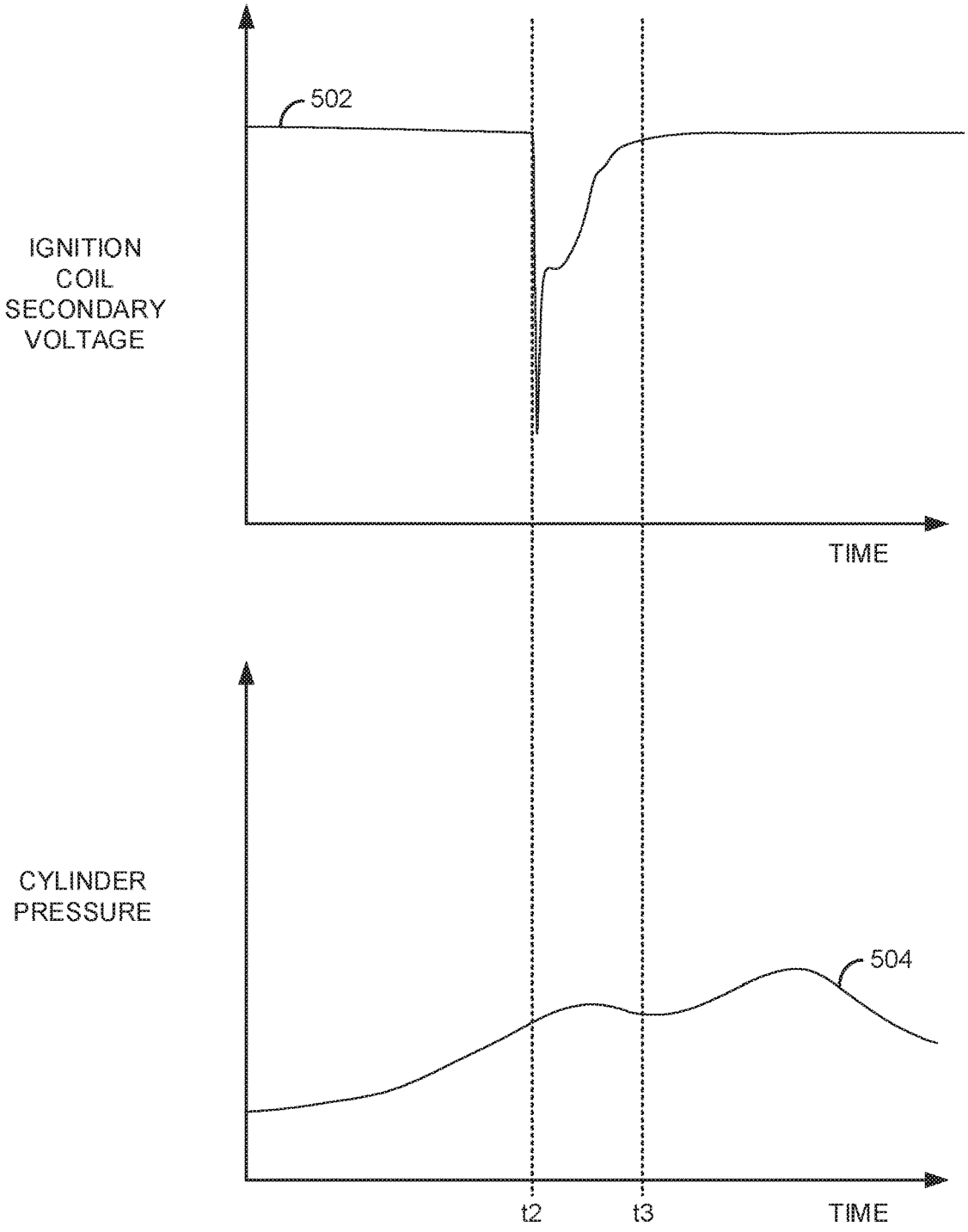
FIG. 5 shows signals of interest for an ignition coil discharge resulting from a rim fire spark event.
Figure 6:
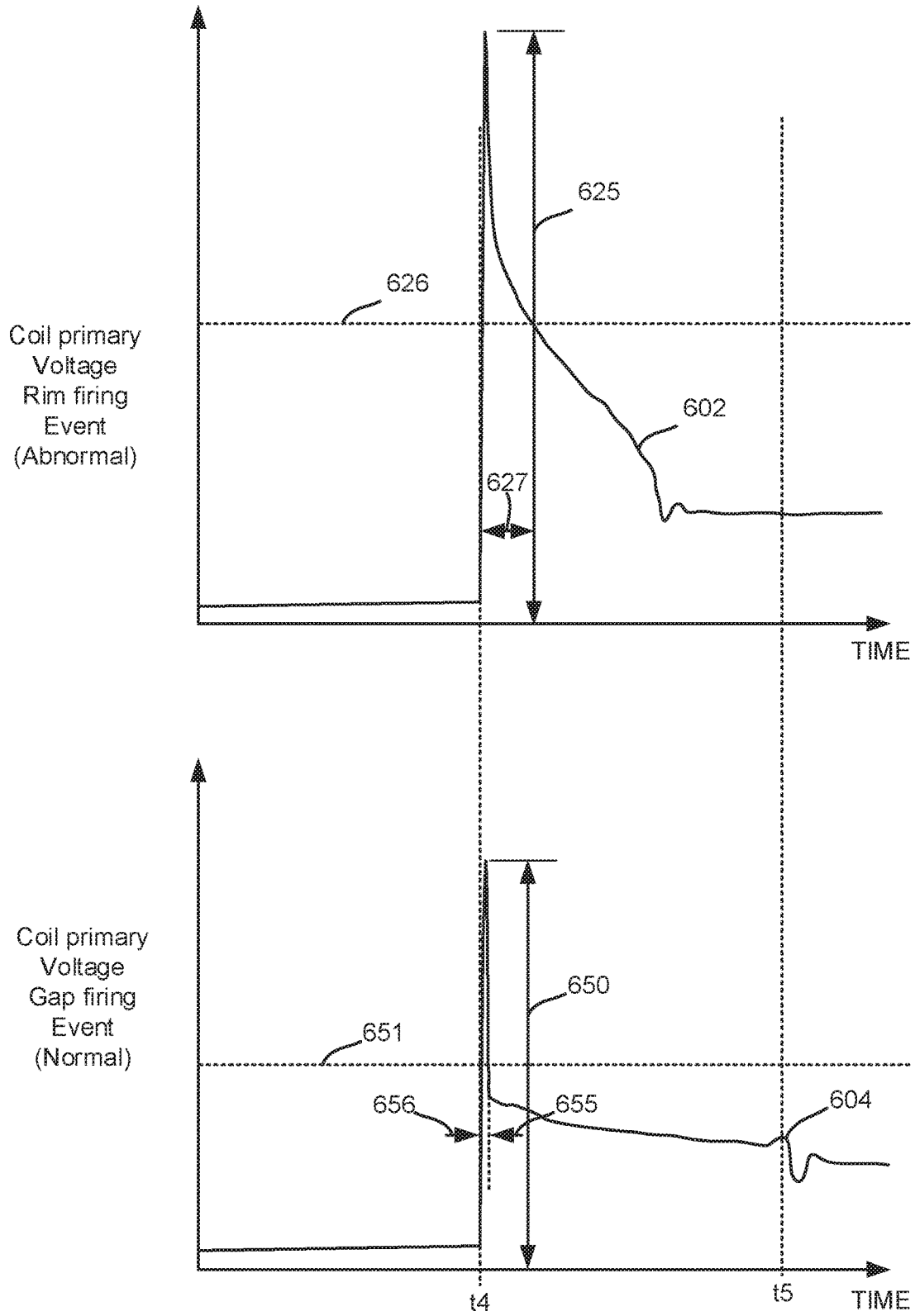
FIGS. 6-8 show illustrations of ways to determine the presence of rim fire spark events.
Figure 7:
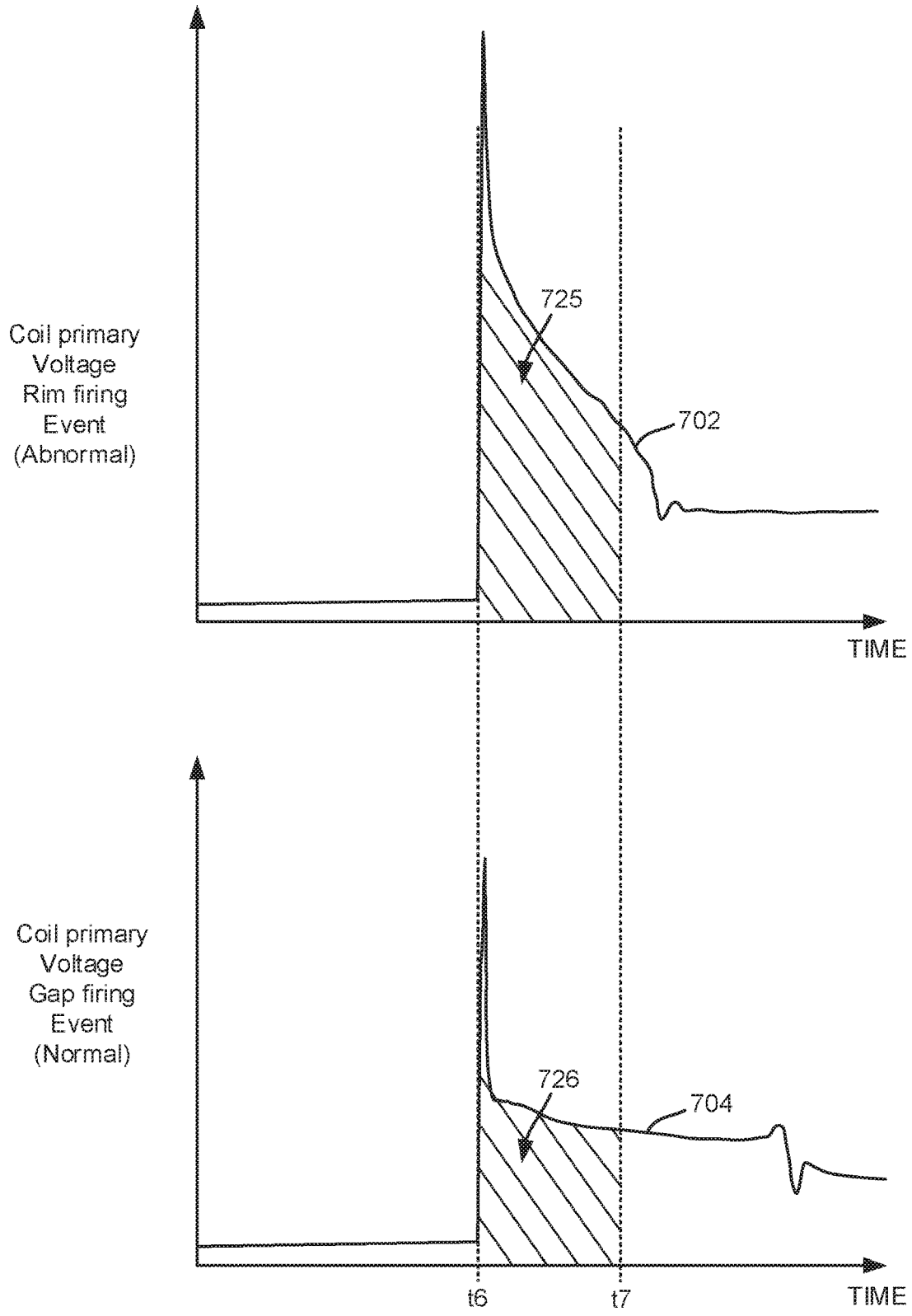
Figure 8:
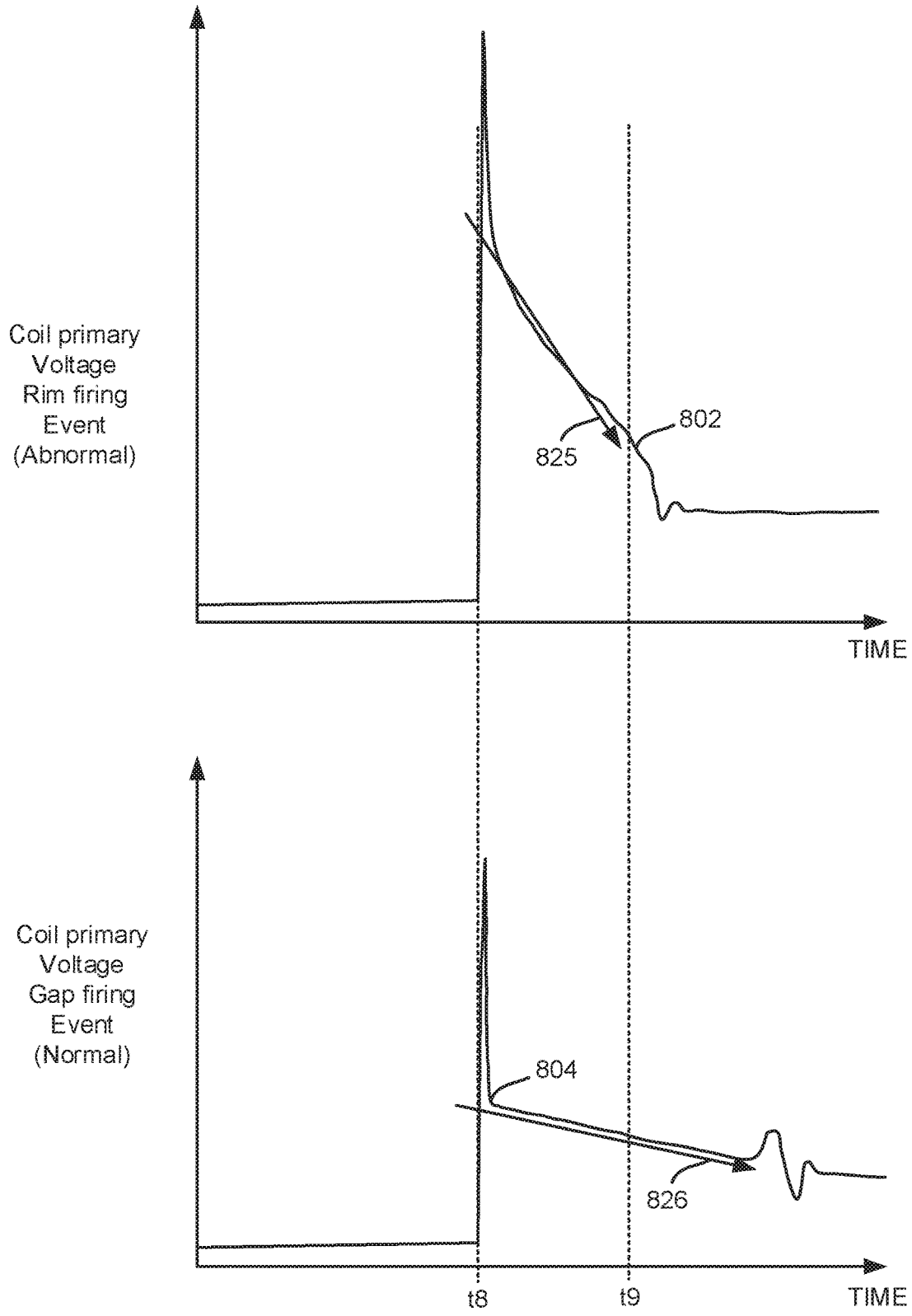

The present description is related to detecting rim firing spark events where a spark occurs between an insulator of a central spark plug electrode and a grounded spark plug casing. In one non-limiting example, the rim firing may be detected in an engine of the type shown in FIGS. 1 and 2. A rim firing spark plug may be detected during engine operation via the circuit shown in FIG. 3. An ignition coil secondary coil voltage for a gap firing spark plug is shown in FIG. 4. An ignition coil secondary coil voltage for a rim firing spark plug is shown in FIG. 5. Approaches for determining the presence of rim firing of a spark plug are shown in FIGS. 6-8. Spark plug rim firing may be detected and compensated according to the method of FIG. 9.

Figure 1:
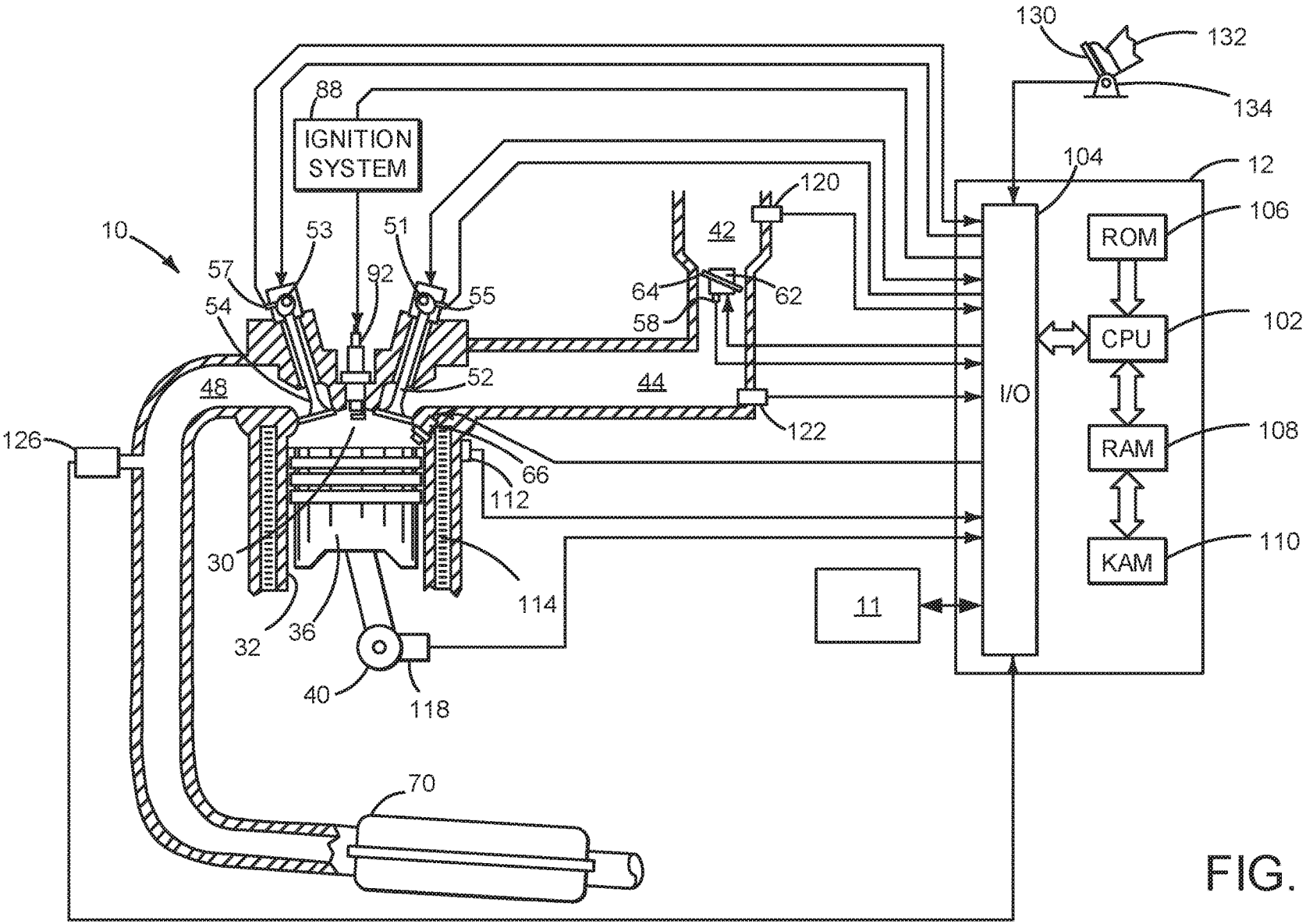
FIG. 1 is a schematic diagram of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1-3. Controller 12 employs the actuators shown in FIGS. 1-3 to adjust engine operation based on the received signals and instructions stored in memory of controller 12.

Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). Fuel injector 66 is supplied operating current from controller 12. In addition, intake manifold 44 is shown communicating with optional electronic throttle 62 which adjusts a position of throttle plate 64 to control air flow from air intake 42 to intake manifold 44.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104 (e.g., analog to digital converters, digital inputs and outputs, pulse width modulation outputs, etc.), read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by human foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. Controller 12 may display data and messages to human/machine interface (e.g., a panel display, dashboard, key switch, or other known interface). Further, controller 12 may receive commands and input from a human via the human/machine interface 11.

In some examples, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Figure 2:
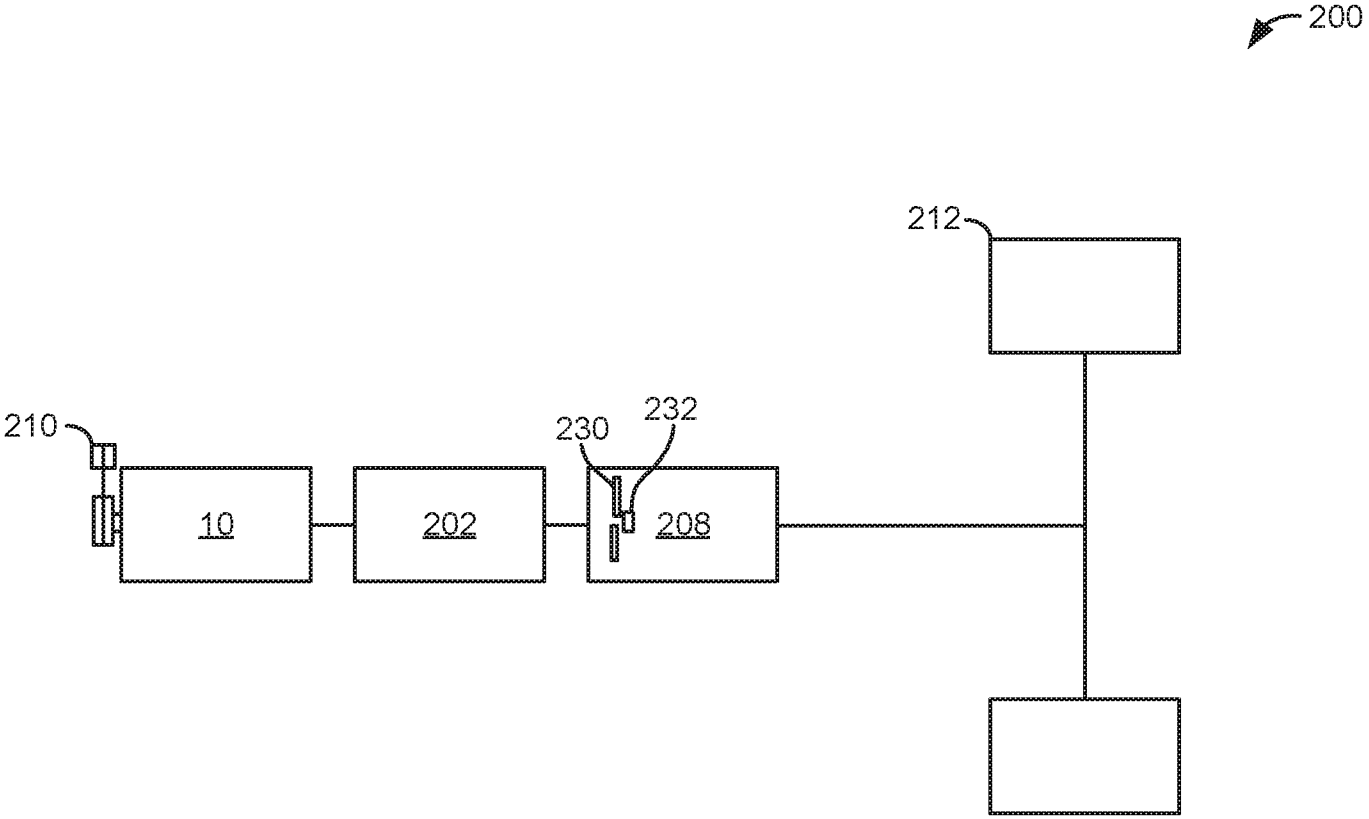
FIG. 2 is a schematic diagram of a vehicle which the engine propels.

FIG. 2 is a schematic diagram of a vehicle drive-train 200. Drive-train 200 may be powered by engine 10 or electric motor 202. Engine 10 may be mechanically coupled to alternator 210, electric motor 202, and transmission 208.

Load may be applied to the engine 10 by alternator 210, electric motor/generator 202, and transmission 208. Each of the alternator 210, electric motor 202, and transmission 208, may be adjusted via adjusting control variables of the respective devices. For example, field current of electric motor/generator 202 may be increased or decreased to increase or decrease a load electric motor/generator 202 applies to engine 10. Similarly, a field current of alternator 210 may be adjusted to increase a load applied to engine 10. Additionally, gears 230-232 of transmission 208 may be shifted to increase or decrease a load applied to engine 10. Engine 10 and electric motor 202 may supply torque to vehicle wheels 212.

Figure 3:
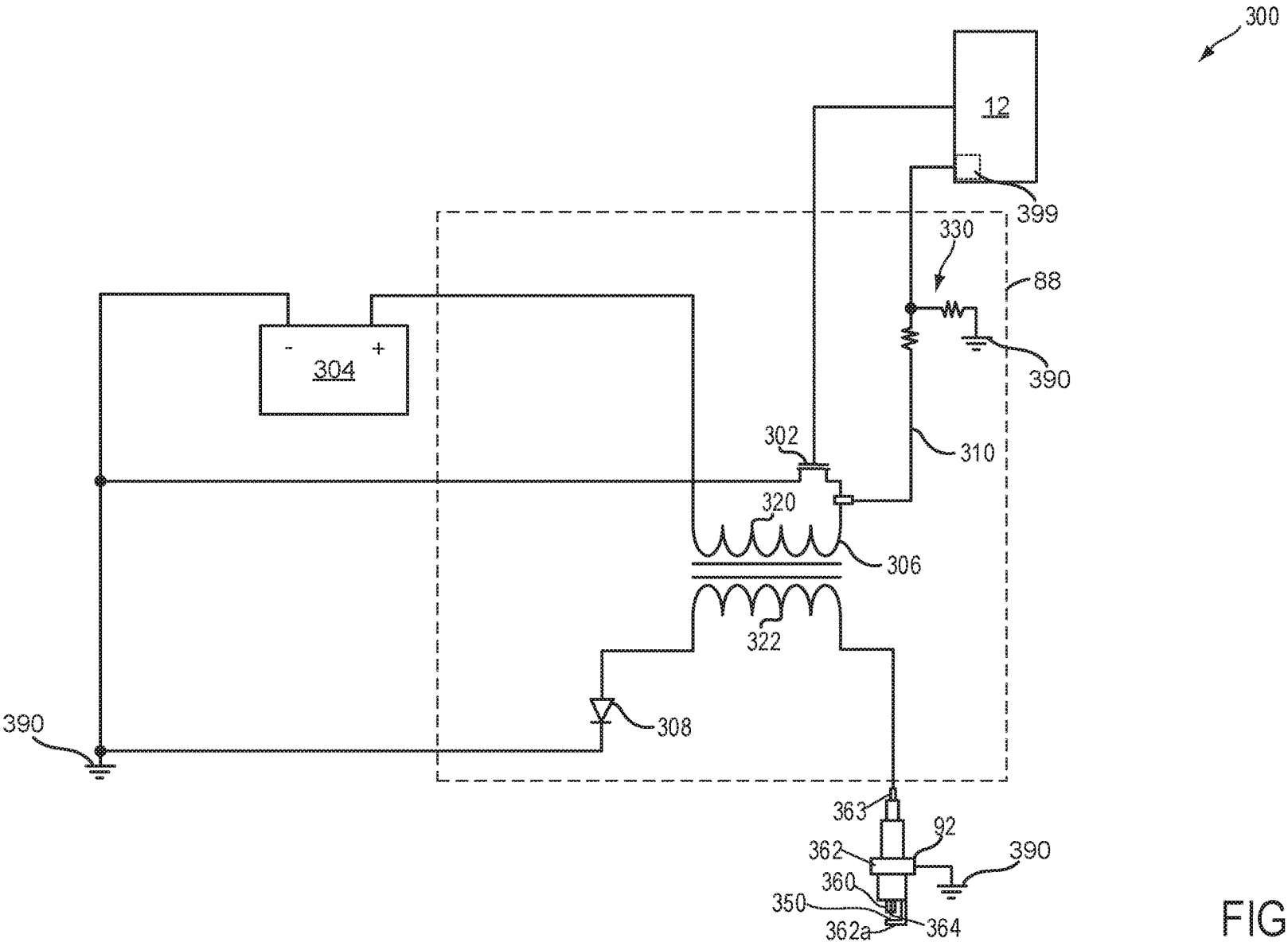
FIG. 3 shows an example circuit for detecting a spark plug that is rim firing.

Referring now to FIG. 3, an example circuit for detecting rim firing of a spark plug (e.g., a spark plug producing a spark in a crevice volume that is located between a ceramic insulator housing an electrode and the spark plug metallic casing) is shown. The circuit of FIG. 3 may be included in the system of FIGS. 1 and 2.

Battery 304 supplies electrical power to ignition system 88 and controller 12. Controller 12 operates switch 302 to charge and discharge ignition coil 306. Controller 12 may optionally include analog circuitry 399 (e.g., an operational amplifier or comparator) to integrate ignition coil primary coil voltage. Ignition coil 306 includes primary coil 320 and secondary coil 322. Ignition coil 306 charges when switch 302 closes to allow current to flow from battery 304 to ignition coil 306. Ignition coil 306 discharges when switch 302 opens after current has been flowing to ignition coil 306. The primary coil 320 may be magnetically coupled to secondary coil 322 and electrically isolated from the secondary coil. Conductor 310 senses a voltage of primary coil 320 and directs the voltage to voltage divider circuit 330. Voltage divider 330 reduces the primary coil voltage to a level that may be input to controller 12. Secondary coil 322 supplies energy to spark plug 92. Spark plug 92 generates a spark in gap 350 when voltage across electrode gap 350 between central electrode 364 and case electrode **362*a* is sufficient to cause current to flow across electrode gap 350. Alternatively, a rim firing event may cause a spark across a crevice that is between insulator 360 and grounded case 362 instead of across electrode gap 350 due to plug fouling. Voltage is supplied to center electrode 364 via secondary coil 322, which is coupled to terminal 363. Case electrode 362*a* is electrically coupled to ground potential 390 via the engine cylinder head (not shown). Diode 308 is reverse biased when ignition coil 306 charges and it is forward biased to ground 390** during a spark.

Thus, the system of FIGS. 1-3 provides for a spark plug monitoring system, comprising: an engine including an ignition coil with a primary coil; and a controller including executable instructions stored in non-transitory memory to integrate a voltage of the primary coil beginning a first predetermined time after the ignition coil begins to discharge to a second predetermined time after the ignition coil begins to discharge, and instructions to adjust operation of the engine responsive to the integration via the controller. The system includes where adjusting operation of the engine includes leaning an air-fuel ratio of an engine cylinder and where the controller is electrically coupled to the ignition coil. The system includes where adjusting operation of the engine includes increasing load, advancing spark timing, increasing engine speed, adjusting cam timing. The system includes where the adjusting operation of the engine includes increasing a charging time of an ignition coil, increasing a total number of charging and discharging events of the ignition coil, and decreasing exhaust gas recirculation flow via adjusting poppet valve timing. The system includes where the integration is numerical integration or linear integration performed via analog circuitry. The system further comprises comparing a value of the integration beginning at the first predetermined time to a value of an integration of a voltage of the primary coil from a different cylinder cycle. The system further comprises adjusting operation of the engine in further response to the value of the integration beginning at the first predetermined time being greater than the value of the integration of the voltage of the primary coil from a different cylinder cycle.

The system of FIGS. 1-3 provides for a spark plug monitoring system, comprising: an engine including an ignition coil; and a controller including executable instructions stored in non-transitory memory to compare a slope of a primary coil voltage from a first discharging event of the ignition coil to a slope of a primary coil voltage from a second discharge event of the ignition coil via the controller, and instructions to at least partially remove a contaminant from a spark plug responsive to the comparison via the controller. The system further comprises additional instructions to at least partially remove the contaminant from the spark plug when an absolute value of the slope of the primary coil voltage from the first abnormal discharging event of the ignition coil is greater than an absolute value of the slope of the primary coil voltage from the second normal discharge event. The system includes where the second discharging event generates a spark in the gap of the spark plug. The system includes where the contaminant is at least partially removed via increasing engine load and increasing engine speed. The system includes where the contaminant is at least partially removed via adjusting an air-fuel mixture, and advancing spark timing and adjusting cam timing. The system includes where the contaminant is at least partially removed via leaning the air-fuel mixture, increasing a total number of charging, and discharging events of the ignition coil, and decreasing exhaust gas recirculation flow via cam timing.

Referring now to FIG. 4, a prophetic ignition coil discharge resulting from a spark in a spark plug gap event is shown. The signals shown in FIG. 4 may be produced via the system of FIGS. 1-3 according to the method of FIG. 9. Vertical markers at times t0 and t1 represent times of interest during the sequence. The ignition coil discharge shown in FIG. 4 represents an ignition coil discharge for a single spark plug gap produced spark during a cycle of a cylinder (e.g., a desired spark generating sequence).

The first plot from the top of FIG. 4 is plot of a secondary ignition coil voltage versus time. The vertical axis represents the secondary ignition coil voltage and the secondary ignition coil voltage value increases in the direction of the vertical axis arrow. The horizontal axis represents time and time increases from left side of the figure to the right side of the figure. Trace 402 represents secondary ignition coil voltage.

The second plot from the top of FIG. 4 represents pressure in the cylinder receiving the spark generated via the secondary voltage shown in the first plot versus time. The vertical axis represents cylinder pressure and cylinder pressure increases in the direction of the vertical axis arrow. The horizontal axis represents time and time increases from the right side of the figure to the left side of the figure. Trace 404 represents pressure in the cylinder that receives the spark.

Before time t0 the secondary coil voltage is at a higher voltage and the cylinder pressure is low but it is increasing. The cylinder pressure increases as the piston (not shown) in the cylinder moves toward top-dead-center compression stroke.

At time t0, the secondary coil voltage drops when the breakdown voltage of the spark plug gap is exceeded and current flows across the spark plug gap that is between the central electrode and the case electrode. The spark ignites an air-fuel mixture in the cylinder, which causes combustion in the cylinder and gas pressure to rise. The secondary coil voltage recovers rather quickly and the cylinder pressure rises quickly and it reaches a peak value slightly after top-dead-center compression stroke.

At time t1, the secondary ignition coil voltage is nearly fully recovered and the cylinder pressure is nearly at a peak value. The cylinder pressure decreases as the piston moves away from top-dead-center compression stroke.

Thus, a desired ignition coil discharge and spark is provided via generating a spark in a gap that is between a spark plug central electrode and a case electrode. The spark causes combustion in the cylinder, thereby increasing pressure in the cylinder so that the force on the piston caused by the increased pressure generates torque at the engine crankshaft.

Referring now to FIG. 5, a prophetic ignition coil discharge resulting from a rim fire spark in a crevice between a ceramic insulator and a spark plug case is shown. The signals shown in FIG. 5 may be produced via the system of FIGS. 1-3. Vertical markers at times t2 and t3 represent times of interest during the sequence. The ignition coil discharge shown in FIG. 5 represents an ignition coil discharge for a single rim fire spark during a cycle of a cylinder.

The first plot from the top of FIG. 5 is plot of a secondary ignition coil voltage versus time. The vertical axis represents the secondary ignition coil voltage and the secondary ignition coil voltage value increases in the direction of the vertical axis arrow. The horizontal axis represents time and time increases from left side of the figure to the right side of the figure. Trace 502 represents secondary ignition coil voltage.

The second plot from the top of FIG. 5 represents pressure in the cylinder receiving the spark generated via the secondary voltage shown in the first plot versus time. The vertical axis represents cylinder pressure and cylinder pressure increases in the direction of the vertical axis arrow. The horizontal axis represents time and time increases from the right side of the figure to the left side of the figure. Trace 504 represents pressure in the cylinder that receives the spark.

Before time t2 the secondary coil voltage is at a higher voltage and the cylinder pressure is low but it is increasing. The cylinder pressure increases as the piston in the cylinder moves toward top-dead-center compression stroke.

At time t2, the secondary coil voltage drops due to a rim fire spark is generated at the spark plug in a crevice that is between the electrical insulator and the spark plug case. The spark causes a slow burn of an air-fuel mixture in the cylinder, which causes slower combustion in the cylinder and a slower increase in cylinder pressure. The secondary ignition coil voltage stays at a lower level for a longer period of time than when a spark is produced in an electrode gap between the central electrode and the case electrode.

At time t3, the secondary ignition coil voltage is nearly fully recovered, but the cylinder pressure increases into the cylinders power stroke such that the peak cylinder pressure is lower than if the spark had been produced in the spark plug gap. The cylinder pressure reaches a peak value late in the combustion stroke and then the cylinder pressure decreases as the piston continues to move away from top-dead-center combustion stroke.

Thus, an undesired ignition coil discharge and spark is provided via generating a spark in a crevice that is between a central electrode insulator and a spark plug case. The rim fire spark causes slower combustion in the cylinder so that cylinder pressure rises at a slower rate as compared to when combustion is initiated by a spark in a gap of a spark plug. The slower rate of combustion may reduce engine power output and increase engine emissions.

Breakdown voltage at the spark plug gap may be very high and difficult to measure via the secondary coil. However, since the ignition coil's primary coil may be magnetically coupled to the ignition coil's secondary ignition coil, the breakdown voltage may be observed and monitored from the primary coil. The primary coil voltage as measured at 310 of FIG. 3 during the spark discharge is the secondary voltage divided by the turns ratio of the ignition coil added to the battery voltage that is supplied to the ignition coil. Consequently, a reflection of the secondary ignition coil voltage may be observed via the primary ignition coil voltage. FIGS. 6-8 show methods for detecting rim fire spark events from primary ignition coil voltage.

Referring now to FIG. 6, a first method for distinguishing an ignition coil discharge resulting from a rim fire spark in a crevice between a ceramic insulator and a spark plug case and a gap generated spark is shown. Vertical markers at times t4 and t5 represent times of interest during the sequence.

The first plot from the top of FIG. 6 is plot of a primary ignition coil voltage versus time for an ignition coil discharge for a single abnormal rim fire spark event. The vertical axis represents the primary ignition coil voltage and the primary ignition coil voltage value increases in the direction of the vertical axis arrow. The horizontal axis represents time and time increases from left side of the figure to the right side of the figure. Trace 602 represents primary ignition coil voltage. The ignition coil discharge shown occurs during a single cycle of a cylinder.

The second plot from the top of FIG. 6 is plot of a primary ignition coil voltage versus time for an ignition coil discharge for a single normal spark plug gap spark event. The vertical axis represents the primary ignition coil voltage and the primary ignition coil voltage value increases in the direction of the vertical axis arrow. The horizontal axis represents time and time increases from left side of the figure to the right side of the figure. Trace 604 represents primary ignition coil voltage. The ignition coil discharge shown occurs during a single cycle of a cylinder.

The first plot and the second plots of FIG. 6 are aligned in time to illustrate the differences between the primary coil voltage observed during a time when a normal spark is generated in a gap and the primary coil voltage observed during a time when the spark is an abnormal rim fire spark. The two sparks are generated in the same cylinder under similar conditions but at different times.

At time t4, the rim fire spark begins in the first plot from the top of FIG. 6. The primary coil voltage in the first plot reaches a maximum or peak value shortly thereafter and the peak primary coil voltage level of the first plot is indicated by arrow 625. The primary coil voltage is reduced to half, in this example, the peak voltage (e.g., an upper threshold) in the first plot, which is indicated by line 626, at a time after time t4 and before time t5. The time between the time the rim fire spark begins (e.g., time t4) and the time the primary coil voltage is half the peak voltage level 625 in the first plot may be indicative of the type of spark produced at the spark plug. In this example, the amount of time is indicated by arrow 627 and it is a relatively long amount of time, which indicates a rim fire spark is generated by the spark plug. It should be noted that the peak primary voltage is a very fast transient event and the ability of circuitry to accurately capture this voltage can vary. For this reason, values other than one half the peak voltage (e.g., 30% to 70% of the peak or upper threshold voltage) may be the basis for determining the presence or absence of rim fire spark.

The gap spark sequence also begins at time t4 and it is shown in the second plot from the top of FIG. 6. The primary coil voltage in the second plot reaches a maximum or peak value shortly after time t4 and the peak or upper threshold primary coil voltage level of the second plot is indicated by arrow 650. The primary coil voltage is reduced to half the peak voltage in the second plot, which is indicated by line 651, at a time shortly after time t4 and before time t5. The time between the time the gap spark begins (e.g., time t4) and the time the primary coil voltage is half the peak voltage level 650 in the second plot is indicative of the type of spark produced at the spark plug. In this example, the amount of time is indicated by the amount of time between arrows 656 and 655. This is a shorter amount of time than the amount of time indicated by arrow 627 in the first plot from the top of FIG. 6. This short amount of time may indicate that the spark generated during the sequence of the second plot from the top of FIG. 6 is a gap spark.

Thus, it may be observed that a rim fire spark may be indicated by a relatively long amount of time between when a breakdown voltage is indicated by the primary coil voltage and a time that the primary voltage is reduced to half its peak or upper threshold value during a cylinder cycle (e.g., time indicated by arrow 627). Further, it may be observed that a gap spark may be indicated by a relatively short amount of time between when a breakdown voltage is indicated by the primary coil voltage and a time that the primary voltage is reduced to half its peak or upper threshold value during a cylinder cycle (e.g., time between arrows 656 and 655).

Referring now to FIG. 7, a second method for distinguishing an ignition coil discharge resulting from a rim fire spark in a crevice between a ceramic insulator and a spark plug case and a gap generated spark is shown. Vertical markers at times t6 and t7 represent times of interest during the sequence.

The first plot from the top of FIG. 7 is plot of a primary ignition coil voltage versus time for an ignition coil discharge for a single rim fire abnormal spark event. The vertical axis represents the primary ignition coil voltage and the primary ignition coil voltage value increases in the direction of the vertical axis arrow. The horizontal axis represents time and time increases from left side of the figure to the right side of the figure. Trace 702 represents primary ignition coil voltage. The ignition coil discharge shown occurs during a single cycle of a cylinder.

The second plot from the top of FIG. 7 is plot of a primary ignition coil voltage versus time for an ignition coil discharge for a single spark plug gap normal spark event. The vertical axis represents the primary ignition coil voltage and the primary ignition coil voltage value increases in the direction of the vertical axis arrow. The horizontal axis represents time and time increases from left side of the figure to the right side of the figure. Trace 704 represents primary ignition coil voltage. The ignition coil discharge shown occurs during a single cycle of a cylinder.

The first plot and the second plots of FIG. 7 are aligned in time to illustrate the differences between the primary coil voltage observed during a time when a spark is generated in a gap and the primary coil voltage observed during a time when the spark is a rim fire spark. The two sparks are generated in the same cylinder under similar conditions but at different times.

At time t6, the rim fire spark begins in the first plot from the top of FIG. 6. The primary coil voltage in the first plot reaches a maximum or peak value shortly thereafter and the primary coil voltage is integrated beginning a predetermined amount of time after time t6 (e.g., the predetermined time may range from 0 to 20 microseconds after time t6). The primary coil voltage is integrated for a predetermined amount of time after the integration begins (e.g., 200 microseconds). In this example, the primary coil voltage is integrated from time t6 to time t7 in the first plot from the top of FIG. 6. The integration value reflects the area that is shaded at 725.

The gap spark also begins at time t6 and it is shown in the second plot from the top of FIG. 6. The primary coil voltage in the second plot reaches a maximum or peak value shortly after time t6 and the primary coil voltage is integrated beginning a predetermined amount of time after time t6 (e.g., the predetermined time may range from 0 to 20 microseconds after time t6). The primary coil voltage is integrated for a predetermined amount of time after the integration begins (e.g., 200 microseconds). In this example, the primary coil voltage is integrated from time t6 to time t7 in the second plot from the top of FIG. 6. The integration value reflects the area that is shaded at 726.

Thus, it may be observed that area 725 is larger than the area 726. Consequently, the rim fire spark of the first plot may be indicated to be a rim fire spark based on the larger value of area 725. The smaller area 726 indicates a gap spark occurs in the sequence of the second plot from the top of FIG. 7.

Referring now to FIG. 8, a third method for distinguishing an ignition coil discharge resulting from a rim fire spark in a crevice between a ceramic insulator and a spark plug case and a gap generated spark is shown. Vertical markers at times t8 and t9 represent times of interest during the sequence.

The first plot from the top of FIG. 8 is plot of a primary ignition coil voltage versus time for an ignition coil discharge for a single rim fire abnormal spark event. The vertical axis represents the primary ignition coil voltage and the primary ignition coil voltage value increases in the direction of the vertical axis arrow. The horizontal axis represents time and time increases from left side of the figure to the right side of the figure. Trace 802 represents primary ignition coil voltage. The ignition coil discharge shown occurs during a single cycle of a cylinder.

The second plot from the top of FIG. 8 is plot of a primary ignition coil voltage versus time for an ignition coil discharge for a single spark plug gap normal spark event. The vertical axis represents the primary ignition coil voltage and the primary ignition coil voltage value increases in the direction of the vertical axis arrow. The horizontal axis represents time and time increases from left side of the figure to the right side of the figure. Trace 804 represents primary ignition coil voltage. The ignition coil discharge shown occurs during a single cycle of a cylinder.

The first plot and the second plots of FIG. 8 are aligned in time to illustrate the differences between the primary coil voltage observed during a time when a spark is generated in a gap and the primary coil voltage observed during a time when the spark is a rim fire spark. The two sparks are generated in the same cylinder under similar conditions but at different times.

At time t8, the rim fire spark begins in the first plot from the top of FIG. 8. The primary coil voltage in the first plot reaches a maximum or peak value shortly thereafter and the peak or upper threshold primary coil voltage level of the first plot occurs. Linear regression of the primary coil voltage begins a predetermined amount of time after time t8 (e.g., the predetermined time may range from 0 to 50 microseconds after time t6). Values of the primary coil voltage are used in a linear regression to determine an equation of a straight line and the absolute value of the slope of the straight line is indicative of the presence or absence of rim firing spark. In this example, the slope of the primary coil voltage between a first predetermined time after beginning of spark (e.g., detection of breakdown voltage) and a second predetermined time after beginning of spark (e.g., time t9) is indicated by arrow 825.

The gap spark also begins at time t8 and it is shown in the second plot from the top of FIG. 8. The primary coil voltage in the second plot reaches a maximum or peak value shortly after time t8. Linear regression of the primary coil voltage begins a predetermined amount of time after time t8 (e.g., the predetermined time may range from 0 to 50 microseconds after time t6). Values of the primary coil voltage are used in a linear regression to determine an equation of a straight line and the absolute value of the slope of the straight line may be indicative of the presence or absence of rim firing spark. In this example, the slope of the primary coil voltage between a first predetermined time after beginning of spark (e.g., detection of breakdown voltage) and a second predetermined time after beginning of spark (e.g., time t9) is indicated by arrow 826.

Thus, it may be observed that the slope of primary coil voltage for a rim fire spark is significantly greater than (steeper) the slope of primary coil voltage for a gap spark. Consequently, a rim fire spark may be indicated by an absolute value of a slope of a primary coil voltage being greater than a threshold value. A gap spark (e.g., desired spark) may be indicated by a slope of a primary coil voltage being less than the threshold value.

Figure 9:
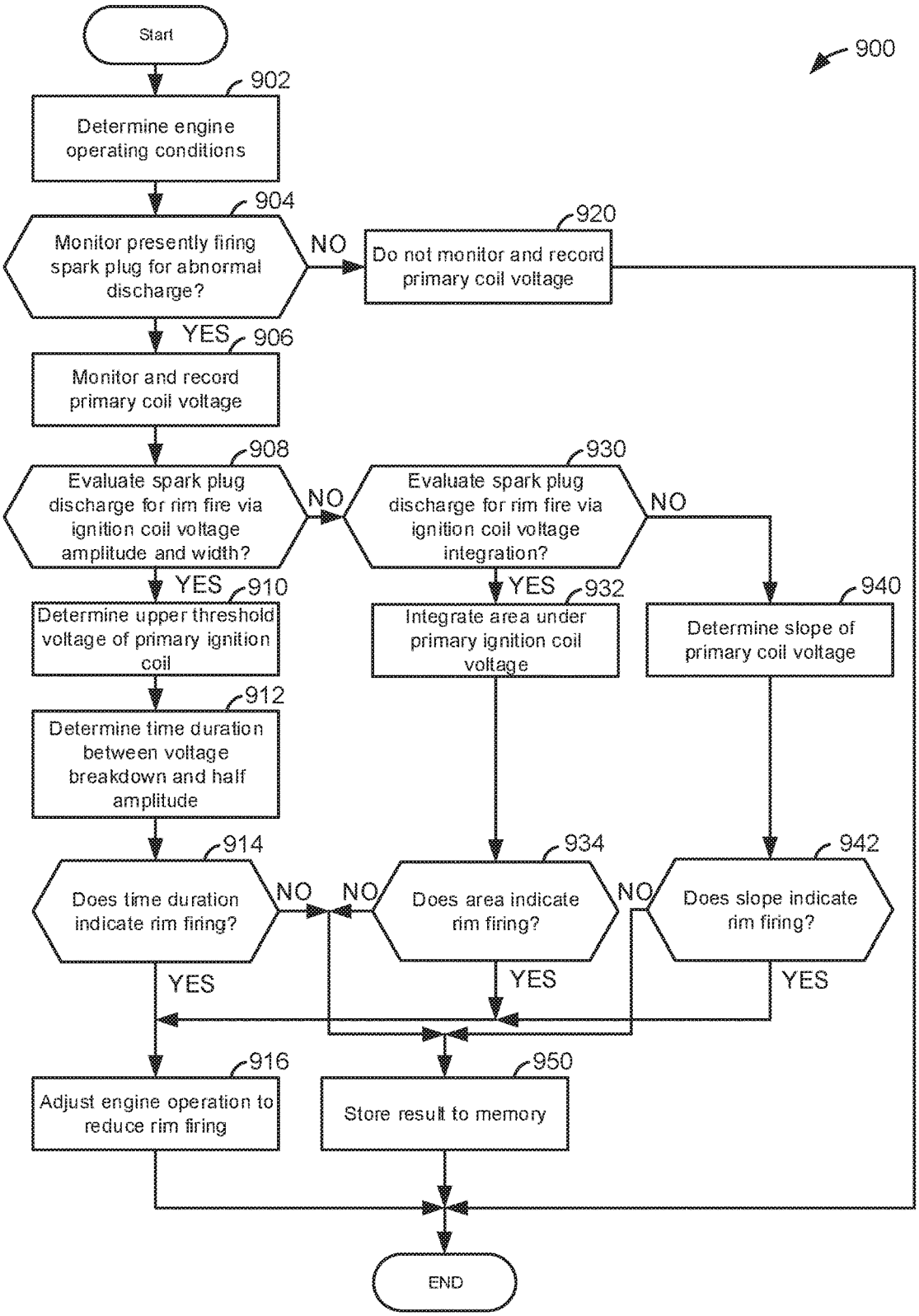
FIG. 9 is a flow chart of an example method for detecting and compensating for rim fire spark events.

Referring now to FIG. 9, a flow chart of a method for detecting rim fire spark at a spark plug is shown. The method of FIG. 9 may be stored as executable instructions in non-transitory memory of controller 12 of FIG. 1 while other portions of the method may be performed via a controller transforming operating states of devices and actuators in the physical world.

At 902, engine operating conditions are determined. Engine operating conditions may include but are not limited engine speed, engine load, engine temperature, ambient temperature, engine air-fuel ratio, and battery voltage. These conditions may be determined via input from the various sensors and actuators that are shown in FIGS. 1-3. Method 900 proceeds to 904 after engine operating conditions are determined.

At 904, method 900 judges whether or not it is desirable to monitor one or more engine spark plugs for abnormal discharges (e.g., rim firing spark events). In one example, spark plugs may be monitored for rim fire events beginning from a time after engine start when the engine first reaches idle speed to a time when the engine is shut-down and stops rotating. If method 900 judges that it is desirable to monitor spark plugs for abnormal dischargers, the answer is yes and method 900 proceeds to 906. Otherwise, the answer is no and method 900 proceeds to 920.

At 920, method 900 does not monitor spark plugs for abnormal discharges (e.g., spark events) and does not record primary coil voltages to controller memory. In one example, method 900 may not read output of controller inputs that reflect voltage of primary ignition coils. Method 900 proceeds to exit.

At 906, method 900 monitors and records voltages of primary coils of ignition coils to controller memory. In one example, method 900 monitors each primary coil of each ignition coil for each engine cylinder each cycle of the cylinder. For example, the voltage of the primary coil for the ignition coil of cylinder number one is monitored and recorded to controller memory each cycle of cylinder number one beginning a first predetermined amount of time since the ignition coil begins to discharge during the cylinder cycle. Method 900 proceeds to 908.

At 908, method 900 judges whether or not to evaluate spark plugs for rim fire via amplitude and width of voltage at primary coils of ignition coils. In one example, method 900 may judge to evaluate spark plugs for rim fire via amplitude and width of voltage at primary coils of ignition coils if a low controller computational load is desired and/or if characteristics of the ignition coil and operating points of a particular vehicle provide distinguishable differences between peak primary coil voltage during rim fire spark events (e.g., abnormal spark) and gap spark events (e.g., desired spark). If method 900 judges that it is desirable to evaluate spark plugs for rim fire via amplitude and width of voltage at primary coils of ignition coils, then the answer is yes and method 900 proceeds to 910. Otherwise, the answer is no and method 900 proceeds to 930.

At 910, method 900 determines an upper threshold voltage for a primary coil of an ignition coil of a cylinder from data in controller memory. In particular, method 900 processes each voltage sample from a primary coil taken between a first predetermined amount of time after discharge of an ignition coil begins or a first predetermined amount of time after a breakdown voltage is detected to a second predetermined amount of time after discharge of an ignition coil begins or a second predetermined amount of time after the breakdown voltage is detected. The one sampled primary coil voltage is compared to another sampled primary coil voltage and the larger of the two primary coil voltages is retained. After all primary coil voltages between the first predetermined amount of time after discharge of an ignition coil begins or the first predetermined amount of time after a breakdown voltage is detected to the second predetermined amount of time after discharge of an ignition coil begins or the second predetermined amount of time after the breakdown voltage is detected are processed, the remaining value is determined to be the upper threshold voltage for the cylinder cycle and the spark generated at the spark plug. The process may be expressed by the logic:

For i=1: n;

Peak_pri_volt=max(Peak_pri_volt; pri_volt(i));

where i is the sample number for primary coil voltages taken between the first predetermined amount of time after discharge of an ignition coil begins or the first predetermined amount of time after the breakdown voltage is detected to the second predetermined amount of time after discharge of an ignition coil begins or the second predetermined amount of time after the breakdown voltage is detected, n is the final number of primary coil voltage samples taken during the cylinder cycle for the cylinder, max is a function that returns the larger value of argument 1 (Peak_pri_volt) and argument 2 (pri_volt(i)), Peak_pri_volt is the upper primary coil voltage taken during the cylinder cycle, and pri_volt is the primary coil voltage for the $i^{th}$ sample. Method 900 proceeds to 912 after determining the upper threshold primary coil voltage recorded during the cylinder cycle.

At 912, method 900 determines an amount of time between a predetermined amount of time after discharge of the ignition coil begins and a time where the primary coil voltage sampled during the cylinder cycle is a predetermined percentage of the upper threshold voltage of the primary coil during the same cylinder cycle (e.g., half or 50% of the upper threshold voltage during the cylinder cycle as shown in FIG. 6). In one example, this process may be described by the following logic:

```
K=0
For i=1: n;
  If (pri_volt(i)<Peak_pri_volt*frac)
    {
      if (K==0)
        {time_to_val=i*sample_time}
    {
    else
        K=1
```

where K is a variable used to determine a single value of time_to_val, i is the sample number, n is the total number of primary coil voltage samples taken during the cylinder cycle for the cylinder, pri_volt(i) is the primary coil voltage at sample i, Peak_pri_volt is the upper threshold primary voltage during the cylinder cycle, frac is a fraction that defines the percentage of the upper threshold primary coil voltage that is the basis for determining a width (e.g., an amount of time) of the primary coil voltage signature observed during a cylinder cycle, sample_time is an amount of time between primary voltage samples, and time_to_val is an amount of time between the first predetermined amount of time after discharge of an ignition coil begins or the first predetermined amount of time after the breakdown voltage is detected to the second predetermined amount of time after discharge of an ignition coil begins or the second predetermined amount of time after the breakdown voltage is detected. Alternatively, integration may be performed via an analog circuit (e.g., an operational amplifier or other comparator and a timer). Note that in this example, the predetermined amount of time after discharge of the ignition coil begins is zero, but in other examples, the predetermined amount of time may be increased and the above logic may be adjusted accordingly. Method 900 proceeds to 914 after the value of time_to_val is determined.

At 914, method 900 judges if the value of time_to_val indicates a rim fire spark has occurred in the cylinder cycle. In one example, the value of time_to_val may be compared to an old or previous value of time_to_val that was determined in a previous cylinder cycle. If the value of time_to_val is a predetermined amount greater than the previous value of time_to_val, then the answer is yes and it may be judged that a rim fire spark occurred during the most recent cylinder cycle of the cylinder in which spark was monitored. Otherwise, the answer is no and method 900 proceeds to 950. Method 900 proceeds to 916 if the answer is yes. The present value of time_to_val may be compared to the previous value of time_to_val because rim firing spark events are sporadic in nature, thereby allowing present values of time_to_val to be compared with the most recent past value of time_to_val to determine the presence or absence of rim firing spark. FIG. 6 graphically depicts this method.

At 916, method 900 adjusts engine operation to reduce the possibility of rim firing and after a calibratable number of events may notify vehicle occupants or a service center that rim firing spark is being produced in the engine. In one example, engine load may be increased via adjusting engine cam timing and/or an engine throttle opening amount, downshifting a transmission to increase engine RPM, and advancing spark timing to increase heat at the spark plug. Additionally, the ignition dwell time or coil charging time may be increased and an air-fuel ratio of the cylinder in which rim fire spark was detected may be leaned. The higher engine load and RPM, leaner air-fuel ratio, advanced spark timing and longer dwell time may tend to remove carbon from the spark plug insulator to reduce the possibility of additional rim fire spark.

Method 900 may also display a visual indication to vehicle occupants via a human/machine interface of the presence of rim firing spark. Further, method 900 may broadcast the rim fire spark information to a remote computer for processing and/or scheduling maintenance on the vehicle. Method 900 proceeds to exit after mitigating the possibility of additional rim fire spark and possibly notifying vehicle occupants of rim fire spark.

At 950, the value of time_to_val for the present cylinder cycle is stored in controller memory as a previous or old value of time_to_val if the presence of rim fire spark is evaluated as a normal spark on the basis of peak primary coil voltage and width. Alternatively, the value of spark_area for the present cylinder cycle is stored in controller memory as a previous or old value of spark_area if the presence of rim fire spark is evaluated as a normal spark on the basis of integrating the primary coil voltage as described at 932. In a different alternative, the value of slope β for the present cylinder cycle is stored in controller memory as a previous or old value of slope β if the presence of rim fire spark is evaluated as a normal spark on the basis of integrating the primary coil voltage as described at 940.

At 930, method 900 judges whether or not to evaluate spark plugs for rim fire via integration of the voltage at primary coils of the ignition coils. In one example, method 900 may judge to evaluate spark plugs for rim fire spark via integration of the voltage at primary coils of ignition coils if characteristics of the ignition coil and operating points of a particular vehicle provide distinguishable differences between integrated values of primary coil voltage during rim fire spark events (e.g., abnormal spark) and gap spark events (e.g., desired spark). This integration can be done digitally or linearly with dedicated analog circuits. If method 900 judges that it is desirable to evaluate spark plugs for rim fire spark via integrating the voltage at primary coils of ignition coils, then the answer is yes and method 900 proceeds to 932. Otherwise, the answer is no and method 900 proceeds to 940.

At 932, method 900 integrates voltage sampled from a primary coil recorded between a first predetermined amount of time after discharge of the ignition coil begins or the first predetermined amount of time after a breakdown voltage is detected to the second predetermined amount of time after discharge of an ignition coil begins or the second predetermined amount of time after the breakdown voltage is detected. In one example, the integration is numerically performed and may be described as:

$$\text{spark_area} = \frac{\Delta t}{2}\sum_{i=1}^{N} \text{pri_volt}(i-1) + \text{pri_volt}(i)$$

where spark_area is the area under the primary coil voltage curve that was recorded for the cylinder cycle at 906, Δt is the amount of time between primary coil voltage samples, N is the total number of primary coil voltage samples taken during the cylinder cycle, i is the $i^{th}$ sample, and pri_volt is the recorded primary coil voltage. Method 900 proceeds to 934 after the integration is performed.

At 934, method 900 judges if the value of spark_area indicates a rim fire spark has occurred in the cylinder cycle. In one example, the value of spark_area may be compared to an old or previous value of spark_area that was determined in a previous cylinder cycle. If the value of spark_area is a predetermined amount greater than the previous value of spark_area, then the answer is yes and it may be judged that a rim fire spark occurred during the most recent cylinder cycle of the cylinder in which spark was monitored. Otherwise, the answer is no and method 900 proceeds to 950. Method 900 proceeds to 916 if the answer is yes. The present value of spark_area may be compared to the previous value of spark_area because rim firing spark events are sporadic in nature, thereby allowing present values of spark_area to be compared with the most recent past value of spark_area to determine the presence or absence of rim firing spark. FIG. 7 graphically depicts this method.

At 940, method 900 determines a slope from voltage of the primary coil recorded between a first predetermined amount of time after discharge of the ignition coil begins or the first predetermined amount of time after a breakdown voltage is detected to the second predetermined amount of time after discharge of an ignition coil begins or the second predetermined amount of time after the breakdown voltage is detected. In one example, the slope is determined via linear regression and it may be described as:

$$\text{pri_volt}(i) = \alpha + \beta \cdot \text{time}(i)$$

$$\alpha = \overline{\text{pri_volt}} - \hat{\beta} \cdot \overline{\text{time}}$$

$$\hat{\beta} = \frac{\sum_{i=1}^{N} (time_i - \overline{\text{time}})(\text{pri_volt}_i - \overline{\text{pri_volt}})}{\sum_{i=1}^{N} (time_i - \overline{\text{time}})^2}$$

where pri_volt(i)=α+βtime(i) describes a linear relationship between the primary coil voltage pri_volt and time, $\hat{\beta}$ is the estimated slope of the primary coil voltage curve that was recorded for the cylinder cycle at 906, β is a slope in the described relationship between pri_volt and time, α is an offset in the described relationship between pri_volt and time, i is the sample number, N is the total number of primary coil voltage samples taken during the cylinder cycle, pri_volt, is the recorded primary coil voltage at sample i, and time, is the time at sample i. Method 900 proceeds to 942 after solving the slope value $\hat{\beta}$.

At 942, method 900 judges if the value of the slope β indicates a rim fire spark has occurred in the cylinder cycle. In one example, the value of slope β may be compared to an old or previous value of slope β that was determined in a previous cylinder cycle. If the absolute value of slope β is a predetermined amount greater than the previous absolute value of slope β, then the answer is yes and it may be judged that a rim fire spark occurred during the most recent cylinder cycle of the cylinder in which spark was monitored. Otherwise, the answer is no and method 900 proceeds to 950. Method 900 proceeds to 916 if the answer is yes. The present value of slope β may be compared to the previous value of slope β because rim firing spark events are sporadic in nature, thereby allowing present values of slope β to be compared with the most recent past value of slope β to determine the presence or absence of rim firing spark. FIG. 8 graphically depicts this method.

Thus, the method of FIG. 9 provides for a method for monitoring a spark plug, comprising: charging an ignition coil supplying electrical energy to the spark plug; and adjusting engine operation via a controller in response to a voltage of a primary ignition coil at a time where the voltage of the primary ignition coil is an adjustable percentage of a peak voltage resulting from discharging the ignition coil during a cycle of a cylinder. The method includes where the time is longer for an abnormal spark than for a normal spark. The method includes where the peak voltage is a maximum voltage of the primary ignition coil during the cycle of the cylinder. The method includes where adjusting engine operation includes leaning an air-fuel mixture, advancing engine spark timing, increasing engine speed, and adjusting cam timing. The method includes where adjusting engine operation includes increasing engine load, increasing a charging time of an ignition coil, increasing a total number of charging and discharging events of the ignition coil, and decreasing exhaust gas recirculation. The method further comprises generating a spark via a secondary ignition coil that is magnetically coupled to the primary ignition coil. The method includes where the spark is generated at a spark plug.

As will be appreciated by one of ordinary skill in the art, routines described in herein may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, or alternative fuel configurations could use the present description to advantage.

The invention claimed is:

1. A method for monitoring a spark plug, comprising:

charging an ignition coil supplying electrical energy to the spark plug; and adjusting engine operation via a controller in response to a voltage of a primary ignition coil at a time where the voltage of the primary ignition coil is an adjustable percentage of a peak voltage resulting from discharging the ignition coil during a cycle of a cylinder.

2. The method of claim 1, where the time is longer for an abnormal spark than for a normal spark.

3. The method of claim 1, where the peak voltage is a maximum voltage of the primary ignition coil during the cycle of the cylinder.

4. The method of claim 1, where adjusting engine operation includes leaning an air-fuel mixture, advancing engine spark timing, increasing engine speed, and adjusting cam timing.

5. The method of claim 1, where adjusting engine operation includes increasing engine load, increasing a charging time of the ignition coil, increasing a total number of charging and discharging events of the ignition coil, and decreasing exhaust gas recirculation.

6. The method of claim 1, further comprising generating a spark via a secondary ignition coil that is magnetically coupled to the primary ignition coil.

7. The method of claim 6, where the spark is generated at a spark plug.

* * * * *